US005657714A

United States Patent [19]

Hsia et al.

[11] Patent Number: 5,657,714

[45] Date of Patent: Aug. 19, 1997

[54] METHODS AND MEANS OF TRANSPORTING FRESH WATER ACROSS OCEANS

[76] Inventors: Chih-Yu Hsia, 301 Warren Way; Chih-Hung Hsia, 210 W. Las Tunas Dr., both of Arcadia, Calif. 91006

[21] Appl. No.: 540,250

[22] Filed: Oct. 6, 1995

[51] Int. Cl.[6] ..... B65D 88/78

[52] U.S. Cl. ..... 114/256; 114/242

[58] Field of Search ..... 441/35, 133; 114/256, 114/257, 242, 72, 74 R, 74 T

[56] References Cited

U.S. PATENT DOCUMENTS

| | | | |
|---|---|---|---|
| 3,067,712 | 12/1962 | Doerpinghaus . | |
| 3,750,723 | 8/1973 | Schirtzinger | 441/133 |
| 3,779,196 | 12/1973 | Knaus et al. . | |
| 4,399,768 | 8/1983 | Alkner et al. . | |
| 5,355,819 | 10/1994 | Hsia et al. . | |

FOREIGN PATENT DOCUMENTS

| | | |
|---|---|---|
| 730652 | 5/1955 | United Kingdom . |
| 837668 | 6/1960 | United Kingdom . |

*Primary Examiner*—Stephen Avila
*Attorney, Agent, or Firm*—William W. Haefliger

[57] ABSTRACT

The method of moving fresh water via the sea, that includes providing a bag to float in the sea, and filling fresh water into the bag at a fill location; towing the bag in the sea, to a fresh water removal location; providing an apparatus floating in the sea at the location and having a sump, and transferring fresh water from the bag to the sump; providing a floating fresh water transfer duct to extend from the location to a water-receiving point, and transferring fresh water from the sump to the water-receiving point by flowing the fresh water through the floating transfer duct; and towing the bag from which fresh water has been transferred away from the water removal location for reuse as by fresh water refilling into the bag.

26 Claims, 23 Drawing Sheets

METHODS AND MEANS OF TRANSPORTING FRESH WATER ACROSS OCEANS

BACKGROUND OF THE INVENTION

This invention relates to means and methods of transporting fresh water across oceans. This invention can help to redistribute global fresh water resources.

U.S. Pat. No. 5,355,819 to Hsia et al. depicted a general approach to the methods of transporting low-density liquids across oceans. The present invention modifies, expands, and tailors the method and means of the previous patent to the herein disclosed improved methods and means of transporting fresh water by bags across oceans.

SUMMARY OF THE INVENTION

When fresh water is contained in a lightweight bag, the bag of fresh water will float on the sea, the walls of the bag keeping the low density liquid from mixing with sea water. Since the density of fresh water is only slightly lower than that of sea water, the top of the lightweight bag, which is filled with fresh water, will float at a level very close to the sea water surface. (The net buoyancy of the bag determines whether the top of the bag will be above or below the sea water surface.) Because of the flexibility and floatability of the bag of fresh water, the hydrodynamic forces normally acting on an ordinary floating body, such as a ship, will not be significant to the bag.

While the bag is floating in the sea, its weight will be supported by the sea water. Since the bag is lightweight, the pressure inside the bag will be low, and the bag material, therefore, will not be subjected to high stresses, whereby the bag of fresh water will float harmonically with sea waves. The bag can be transported by towing, and a specially designed and built net may be placed on each of the fresh water filled bags, whereby the bag can then be towed by a tug boat. The towing speed will be low and the net may take away the stress of towing. The integrity of the bag will remain while it is at sea.

During its filling or draining, the bag's weight may be supported by specially designed floats, or simply by sea water. Fresh water may be pumped via floating tubes made of flexible, lightweight material to the floats, or via specially designed pumping towers into the bags from pumping boats anchored on the river, or a pool of fresh water created by flexible floating belts. Fresh water may be directly pumped into the bags via the floating tubes. Fresh water may be supplied from fresh water reservoirs or tanks on shore, river water being one fresh water source. The specially designed floats can be ballasted or de-ballasted. Ballasting the float used for filling the bag will separate it from the filled bag because it will controllably sink, and the bag contained by the float will itself float.

Draining of the bags can be done by using the specially design floats, by pumping towers or by nets mounted with inflatable air bags. When the fresh water filled bag is contained in the float used for draining, de-ballasting it will raise the bag above sea water surface, therefore, allowing the bag to be separated from sea water. De-ballasting the float used for draining will also help to drain the bag. Fresh water drained from the bag can then flow through large, flexible tubes into a tank or a sump from which fresh water can be pumped into water treatment facilities. The tank or sump may be built partially on a beach and to have vertical walls, a flexible liner and/or a flexible cover, or a roof. The flexible liner is used to separate the fresh water from the sea water, and will balance them to automatically maintain room for storage of the fresh water.

Alternatively, fresh water can be transported by a long, floating tube with a series of pumping towers anchored along the tube line. The fresh water from the upstream pumping tower will enter the pumping tower, then be boosted into the next floating tube to the next pumping tower. This process will be repeated until the fresh water reaches its destination. Anchors may be provided for the floating tubes to overcome the ocean currents and the friction forces acting on the walls of the floating tubes.

These and other objects and advantages of the invention, as well as the details of an illustrative embodiment, will be more fully understood from the following specification and drawings, in which:

DRAWING DESCRIPTION

DETAILED DESCRIPTION

Redistribution of globe fresh water resources can be relatively easily accomplished with the use of the herein disclosed methods and means. The methods will be described together with their required equipments or facilities. Once the equipments or facilities are described, unless otherwise clearly described differently, they may be repeatedly reused without being specifically described again in this general description.

Figure 1:
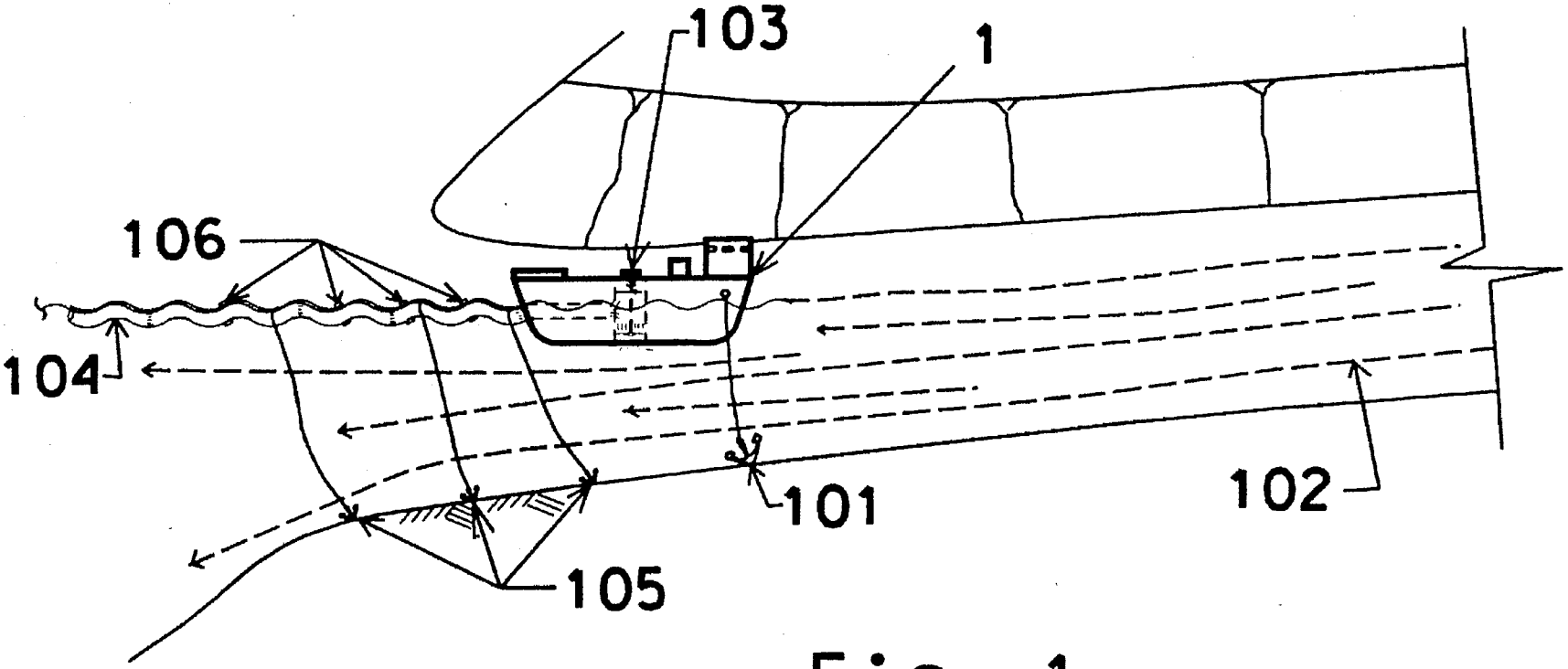
FIG. 1 is a schematic sectional side view of a pumping boat and a portion of a filling tube.

Referring to FIG. 1, a pumping boat 1 is positioned by an anchor 101 in a river 102 where excess fresh water is available for take. The pumping boat is equipped with pumps 103 which suck the fresh water from the river and discharge it into a floating delivery tube 104 made of flexible membrane material, such as HYPERLON. Anchors 105 and floats 106 may be connected to the floating tube, as shown, at intervals needed to stabilize the upstream reach of the floating tube, since at this reach water density inside the floating tube is about the same as that of the ambient water, and since river water velocity is high.

The floats 106, being made of lightweight material, will keep the floating tube 104 afloat near the river water surface. The anchors will help the floating tube stay in its desired location, since the turbulence in the river may be high. The flow velocity inside the floating delivery tube 104 will be low; and the walls of the floating tube will be smooth. The water velocity on the river itself is low. Thus, the friction and drag forces on the floating tube inner and outer walls will be small. Therefore, the walls of the floating tube are not subjected to high stresses created by friction and drag forces on the walls.

Figure 5:
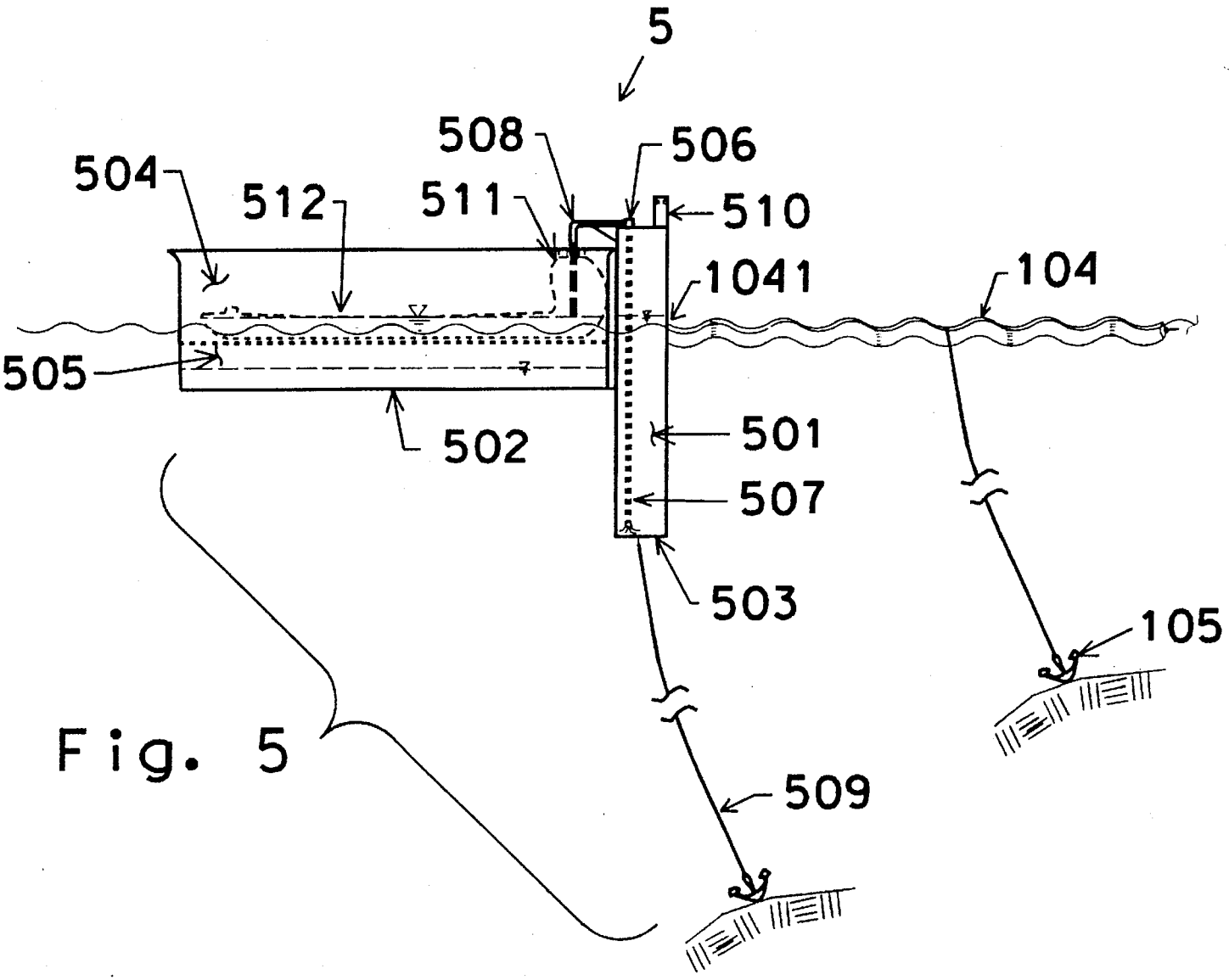
FIG. 5 is an elevational view of a filling float in which a transport bag is contained and being filled.

Referring to FIG. 5, the downstream end 1041 of the floating tube 104 is connected to a sump 501 in a filling float 5. The fresh water in the floating tube 104 flows into the sump, which defines a space to store water. The filling float has two distinct portions: the submergible portion 502 and the stationary portion 503. The submergible portion defines a floating dock with a bag containment chamber 504 above one or more lower air chambers 505. The bag chamber is sized to receive and hold a water-filled transport bag 512.

The air chamber contains air and sea water. The ratio of the air and water contents in the air chamber can be altered. Varying of the air/water ratios controls the ballasting of the submergible portion 502, which in turn controls the buoyancy of the submergible portion. The submergible portion can thus submerge or float, in a manner similar to a submarine. The stationary portion 503 of the filling float 5 basically is a floating pumping station, which has the aforementioned sump 501, pumps 506, an anchoring means 509, a control room 510, and pump power supply means **506*a*. The pump suction line 507 removes water from the sump 501, and the pump discharge line 508 discharges water into the bag 512**.

The anchoring means may include anchors and chains, as shown in 509, or propellers or equivalents (not shown), each of which can keep the filling float 5 in a fixed location. Control room 510 allows operators to control the function of or at the filling float. The pump power supply means **506*a*** can operate to provide electricity generation or drive systems, if the pumps have motors. The pump power supply means may include engines, turbines, and/or fuel tanks, if the pumps have no motors.

The end of the pump discharge line can be of flexible or telescope-type construction, so that water can be smoothly discharged into an inlet opening 511 of bag 512. The opening 511 can be optionally raised, as shown in FIG. 5, by suitable fastening means (not shown) attached to the bag chamber. Or, the opening can be optionally lowered for floating on the in-filled fresh water body, while the flexible or telescope-type construction of the pump discharge line is lowered to discharge water into the bag.

The bag 512 itself is made of any suitable, flexible, lightweight sheet material, such as HYPERLON. Floats made of lightweight material may be optionally mounted on the surface of the bag to increase its buoyancy, so that it can float (when filled with fresh water) near the sea water surface. The bag may optionally have stripes attached to the walls of the bag. The stripes may be made of the same material as the bag itself, or any other suitable material. The stripes will strengthen the bag so that it can be subjected, without damage, to additional stress under towing, filling or draining.

Figure 27:
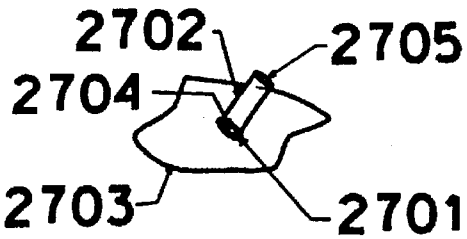
FIG. 27 is a schematic view of an access opening made on or into a fresh water transport bag.

Referring to FIG. 27, a rim or flange 2701 of a short tube 2702, made of the same material as that of the bag, can be attached as by gluing, on the wall of the bag 2703. The bag wall within the mounted rim or flange of the short tube can be cut to create an opening 2704 for the bag. Any desired number of openings can be made on the bag. Fresh water or other fluid can enter or exit a bag through the openings, whereby the filling and the draining of a bag can be done through the openings.

During filling or draining, the free rim or flange 2705 of the short tube can be connected to a floating tube, a pipe, a tube, or equivalent, so that fresh water can be transferred. When an opening of the bag is no longer needed, the opening of the short tube can be sealed up optionally at or near its mounted rim or flange so that it will be closed. The extra short tube length can be trimmed away after the sealing.

Figure 8:
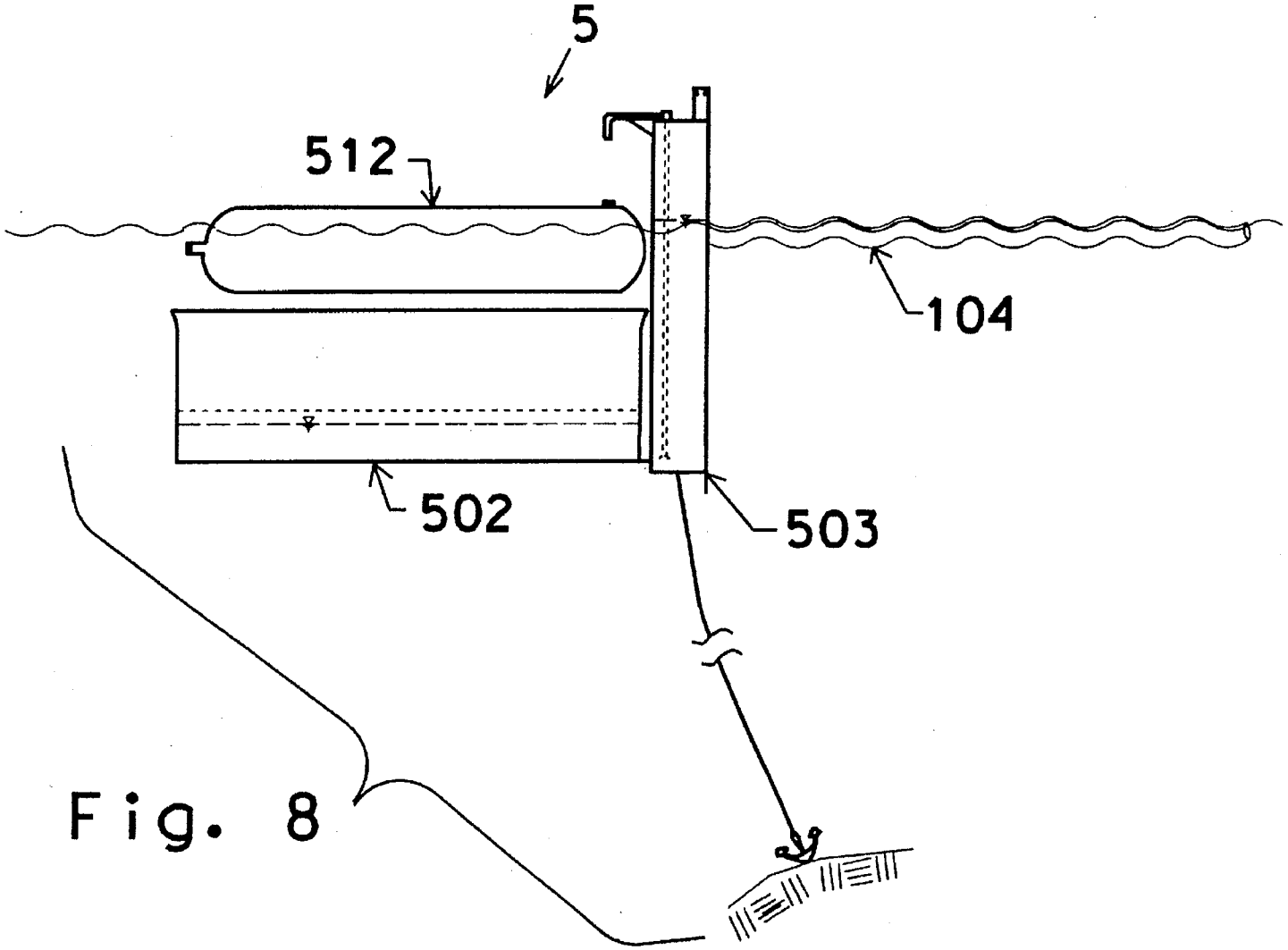
FIG. 8 is an elevation showing the submergible portion of the filling float in its submerged position, while a fresh water filled transport bag is in a floating position above the filling float.

Referring to FIG. 8, when a bag is filled with fresh water, all openings of the bag will be sealed up. The submergible portion 502 of the filling float 5 will be ballasted and sunk to the position shown. The bag 512 will then float up, as shown. Sea water surface as indicated at 800.

Figure 9:
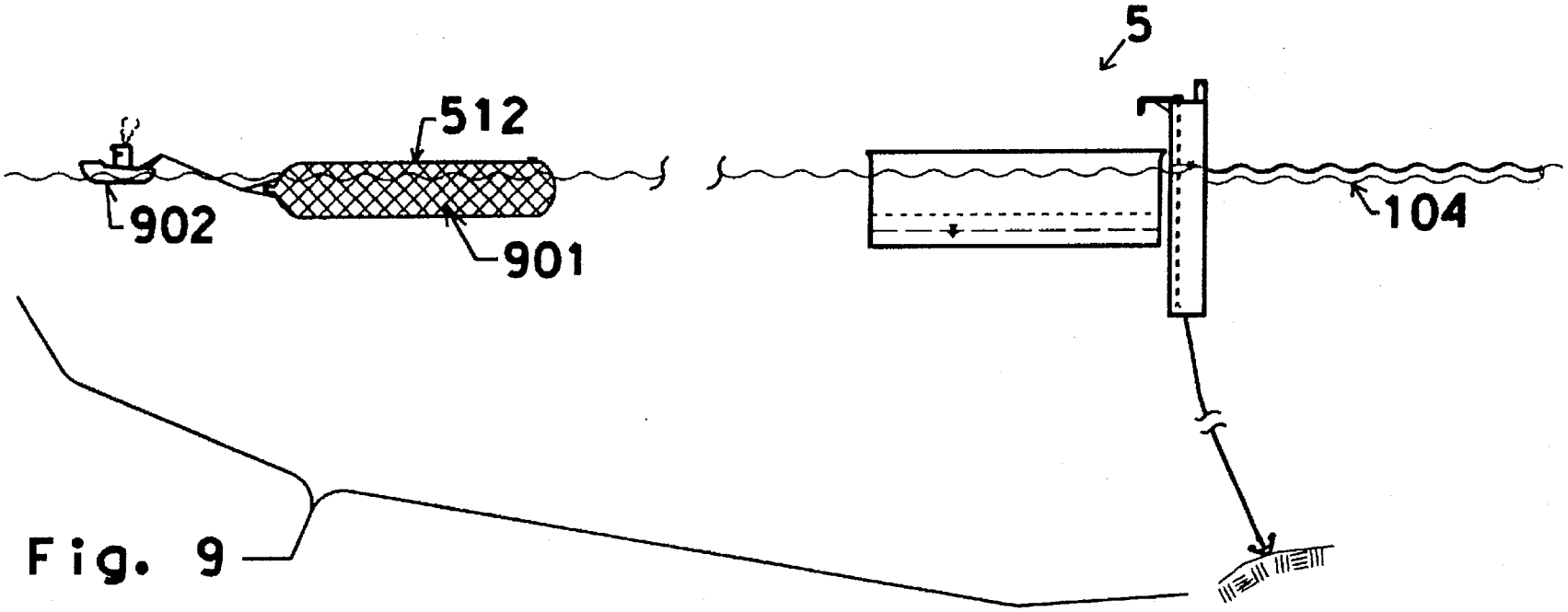
FIG. 9 is a schematic side view showing a fresh water filled transport bag on which a net has been placed and which is being towed by a tug boat.

Referring to FIG. 9, a net 901 may be placed on a bag, if the bag is not strengthened with the aforementioned stripes. The net may be made of any suitable material, so as to take some or even most of the stresses put on the bag, when it is being towed. The bag can then be towed by a tug boat 902 to an assembly place where several columns of chains or trains of bags will typically be assembled, for towing. These filling, towing, assembling, etc., processes will be repeated until a cluster of bags can be assembled.

Figure 11:
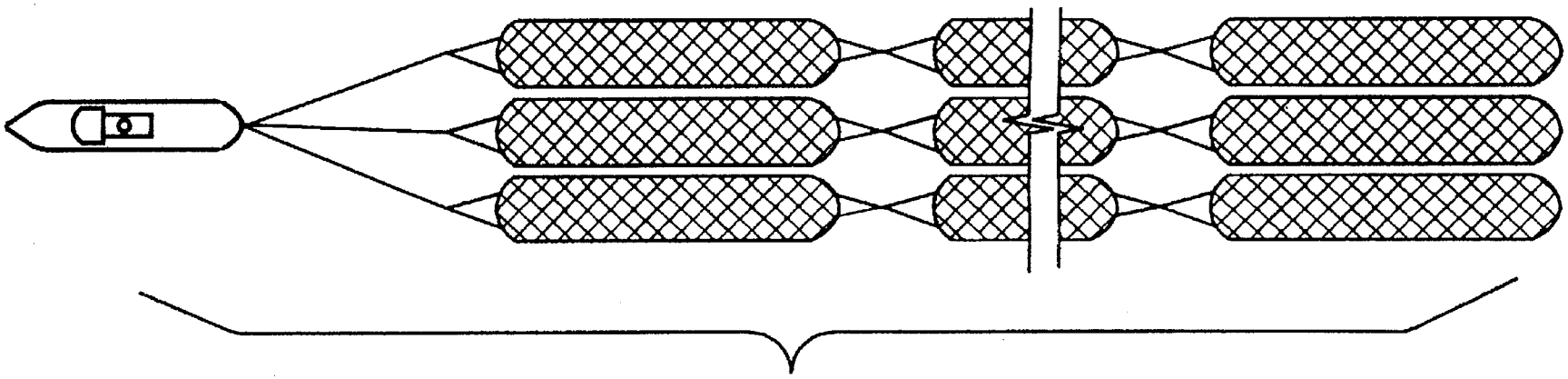
FIG. 11 is a plan view showing many such transport bags and being towed by a tug boat.
Figure 10:
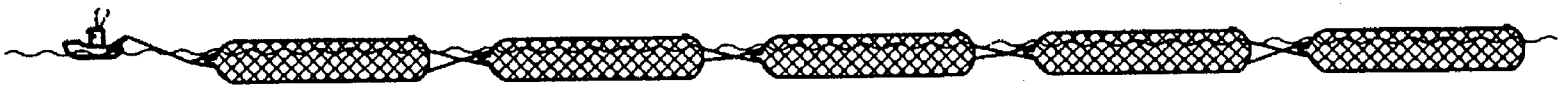
FIG. 10 is a view showing a train of transport bags being towed by a tug boat.
Figure 15:
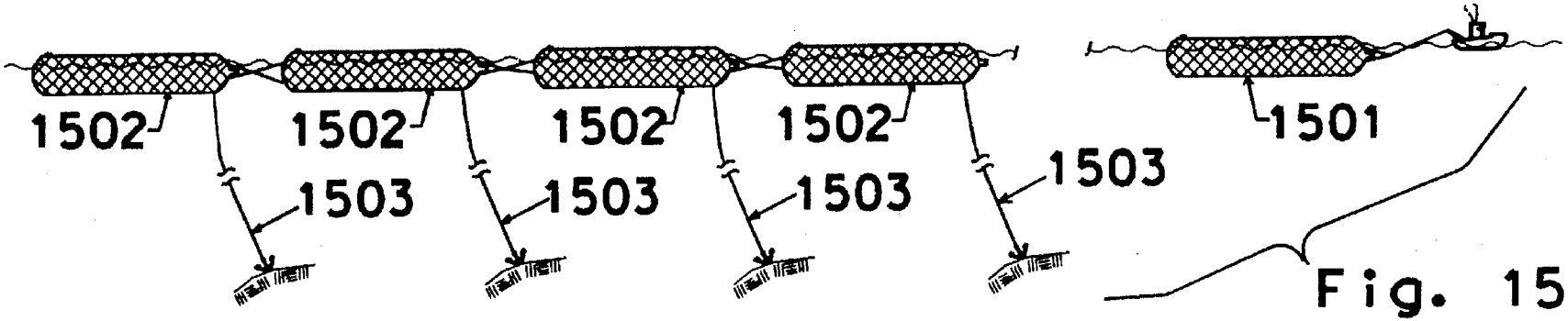
FIG. 15 is an elevational view showing an individual transport bag being towed away by a tug boat from a train of bags.

Referring to FIGS. 10 and 11, a cluster 801 of assembled bags can be towed by a tug boat 902 from near the source of the fresh water to a point or points near their destinations where fresh water demand exists. Referring to FIG. 15, when the assembled and towed bags 1502 arrive near their destinations, a bag 1501 will be detached at line 804 detachment point 804*a* and towed away, as by boat 902, for draining. The remainder of train-connected bags 1502 may be "parked" on the ocean with or without the help of the anchoring systems 1503.

Figure 16:
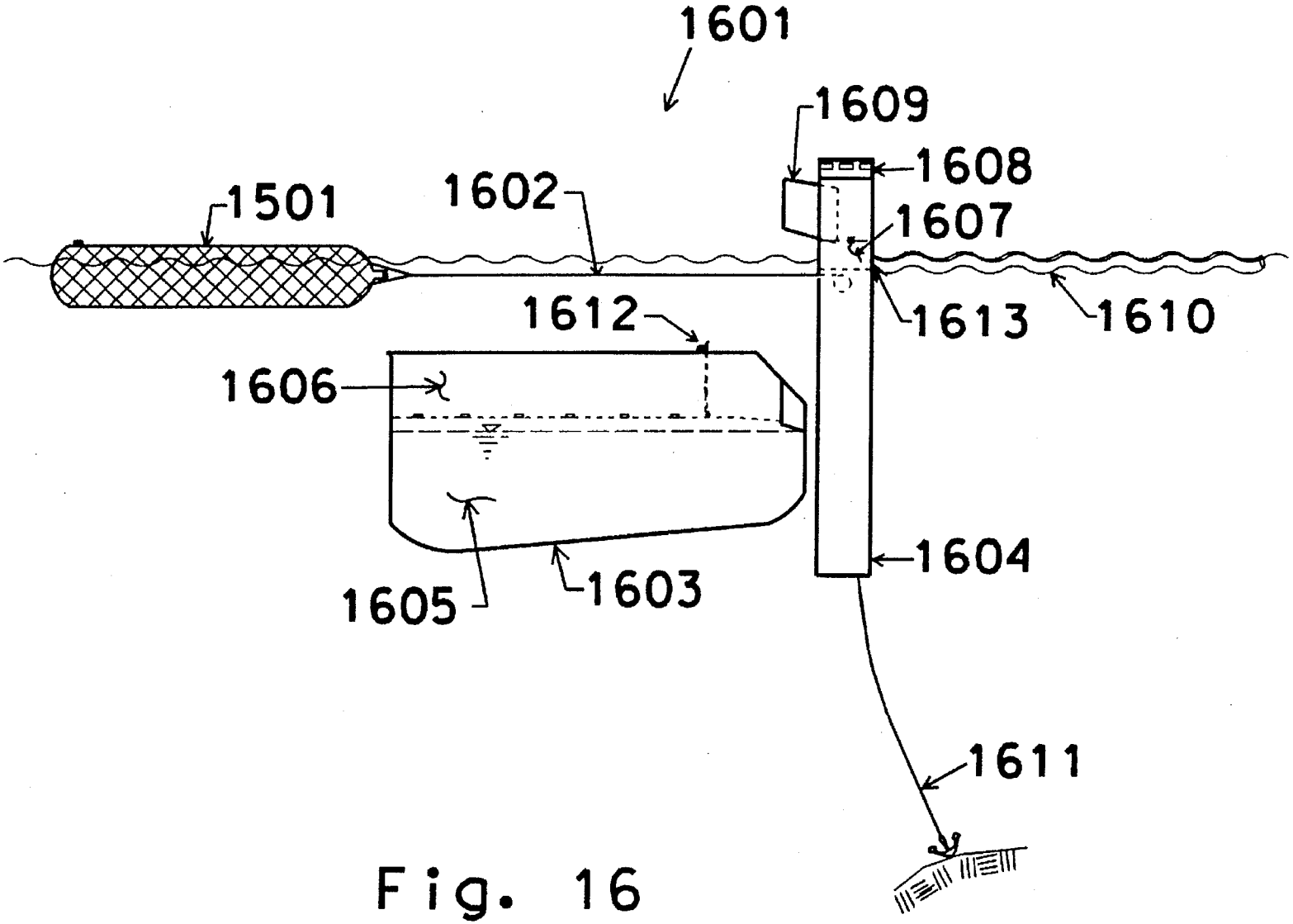
FIGS. 16 and 17 are elevational views showing stages in tugging of a bag toward and to the top of a draining float, a submergible container float being ballasted and in its submerged position.

Referring to FIG. 16, after the detached bag 1501 is towed near a draining float 1601, the towing will be taken over by a pulley system 1602. The draining float consists of two distinctive portions: the submergible portion 1603 and the stationary portion 1604. The submergible portion is basically a floating dock with a bag containment chamber 1606 above one or more lower air chambers 1605. The bag chamber 1606 can hold a bag. The air chamber contains air and sea water. The ratio of the air and water contents in the air chamber can be altered, whereby air/water ratios can control the ballasting of the submergible portion 1603, which in turn controls the buoyancy of the submergible portion. The submergible portion thus can submerge or float, as referred to above. The walls of the bag containment chamber can receive and confine a bag. Sea water in the bag chamber can be drained through openings in the bottoms of the walls. The bag chamber has an inclinable wall 1612, which is the closest chamber wall facing the stationary portion 1634 of the draining float. That inclinable wall has openings through which water drained from openings of the bag can be drained into the stationary portion 1604 of the draining float. The inclinations of the inclinable wall may be provided by a cable, pulley and hinge, system or other available levering means. The inclinable wall can be pivoted on its bottom hinge 1612*a*. Due to the shape of the submergible portion of a draining float, or due to the uneven ratios of many different air chambers of a submergible portion of a draining float, the buoyancy at both longitudinal ends of the submergible portion can be adjusted differently. Therefore, the bottom of the contained bag chamber can be sloped toward the inclinable wall 1612. The sloping of the bottom wall 1612*b* helps the draining of the bag.

The stationary portion 1604 of the draining float is either a floating or an anchored structure, which includes the aforementioned pulley system 1602, a tank 1607, an anchoring means 1611, a control room 1608, a water-receiving system or trough 1609, and a power supply means (not shown). The pulley system is configured to pull a fresh water filled bag 1501. The water-receiving system is a trough which can receive water passing through the openings of the inclinable wall 1612 of the bag containment chamber and convey the discharged water into the tank 1607. The tank 1607 receives water from the water-receiving system, and then passes the water through an opening 1613 into a floating tube 1610, which has the same construction as the aforementioned tube, for transport to a shore-receiving facility. The anchoring means 1611 may include anchors and chains, as shown, or propellers or equivalents (not shown) which-can keep the draining float 1604 fixed location. Control room 1608 provides a space in which operators can control the draining float. The power supply means can be electricity generation or convey systems and their associated facilities, such as fuel storage tanks, cables, transformers, etc.

Figure 17:
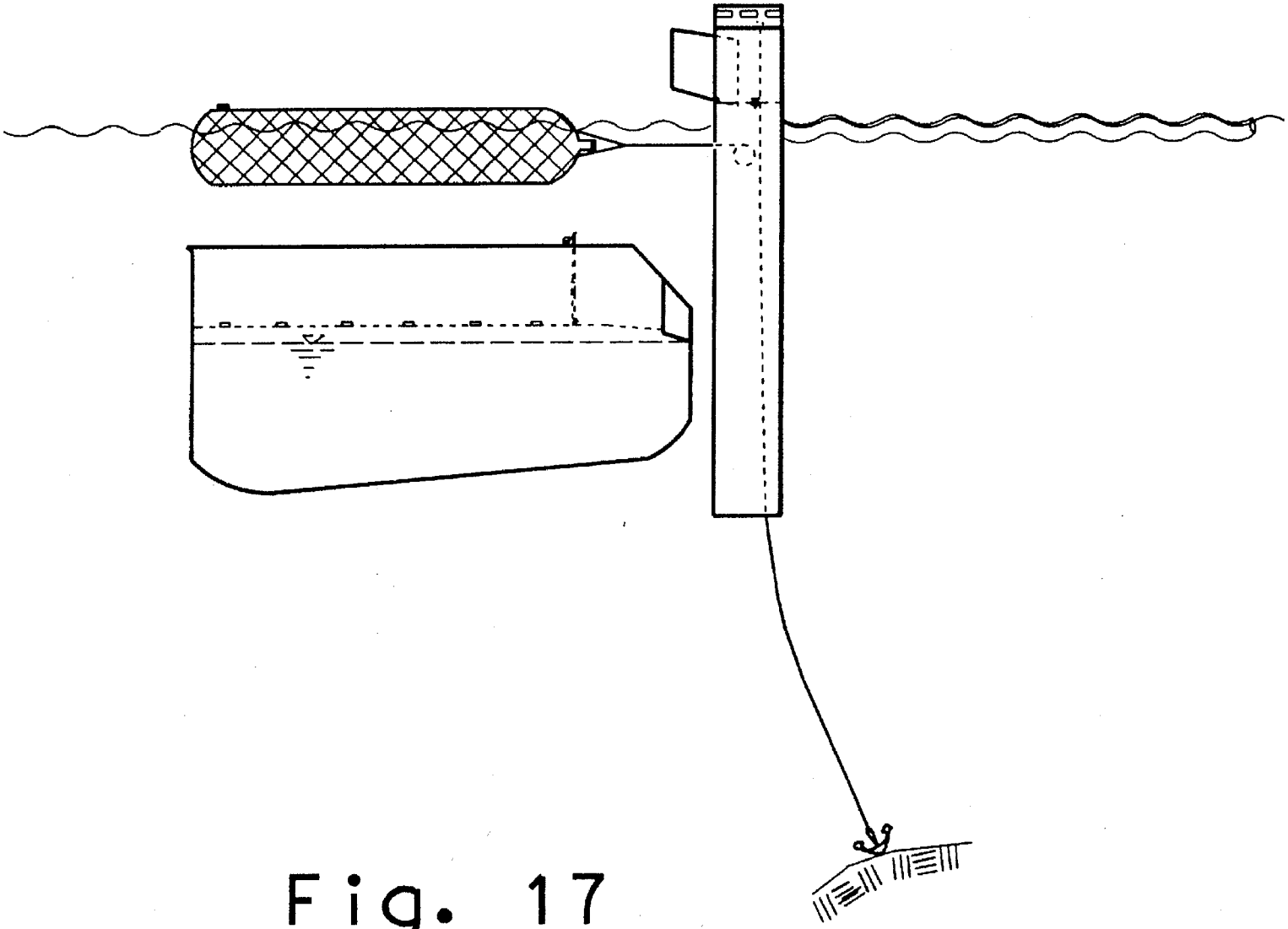
Figure 18:
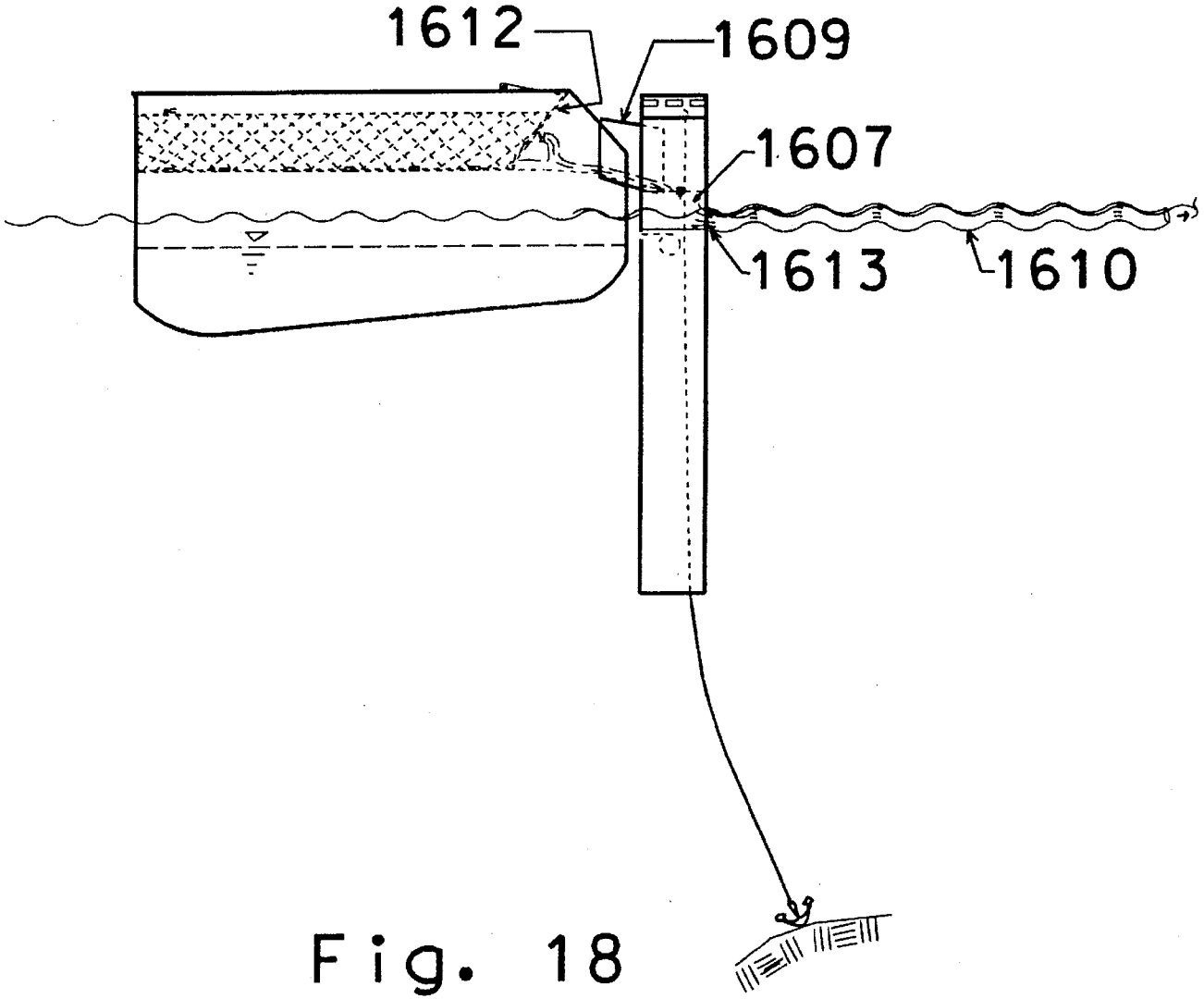
FIG. 18 is an elevational view showing a transport bag being drained by a de-ballasted, submergible draining float.

Referring to FIGS. 17 and 18, when a bag 1501 has arrived above a sunk, submergible portion 1603 of a draining float 1601, the submergible portion will be ballasted first to "scoop up" the laterally traveling bag. Then the submergible portion will be properly deballasted to "raise" the bag so that it can be drained. Openings will be created, as by methods described previously, on the bag near the inclinable wall of the bag chamber. The drained fresh water will pass through the openings of the inclinable wall 1612, the water-receiving system 1609, the tank 1607, the discharge opening 1613, and then enter into floating tube 1610, for transport to a shore facility. See FIG. 18.

Figure 22:
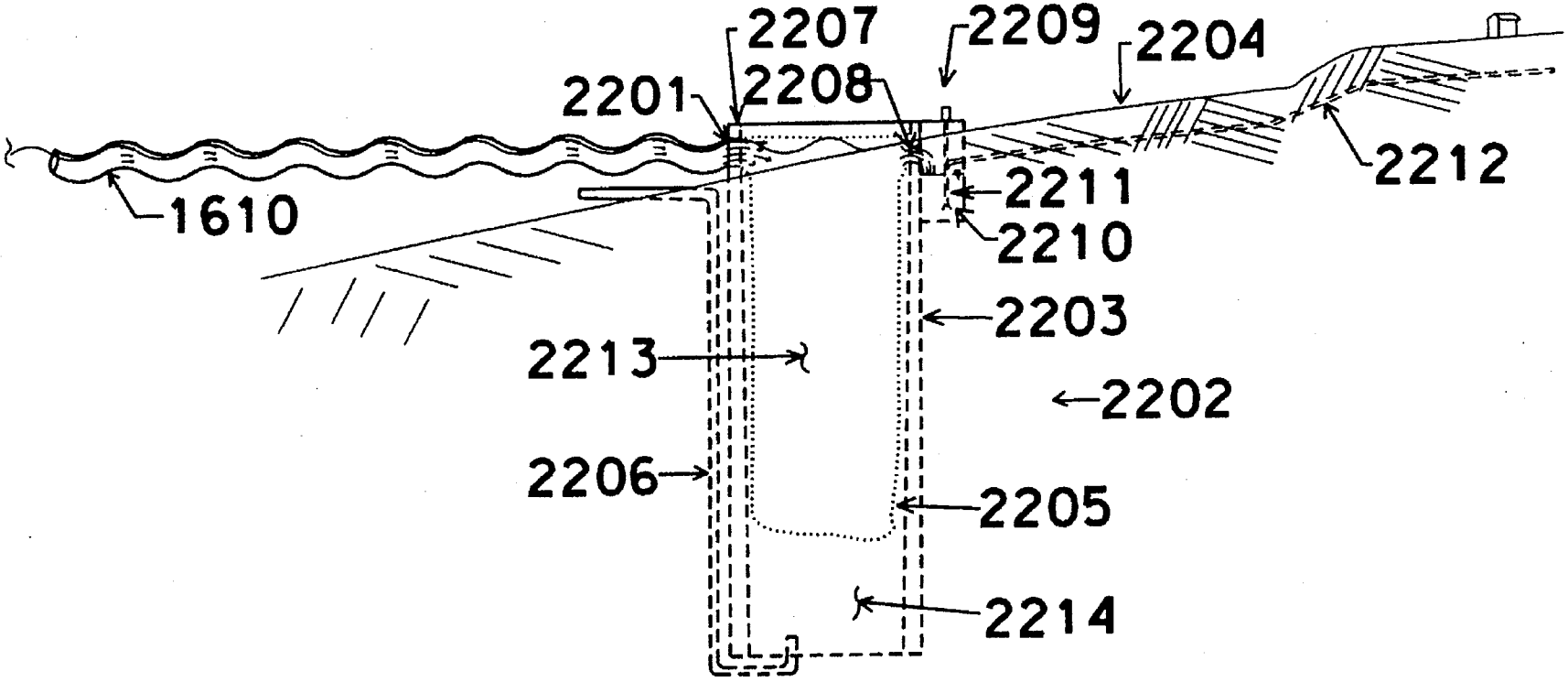
FIG. 22 is a sectional elevational view of a shore tank and its associated floating tube, pumping station and pipeline.

Referring to FIG. 22, the downstream end 2201 of a floating tube 1610 connects with a shore tank 2202, which consists of a large, rigid tube 2203, a liner 2205, an equalization pipe 2206, a cover 2207, an opening 2208, and a pumping plant 2209. The shore tank 2202 facility is constructed near the shore 2204. The upright, rigid tube 2203 is made of any suitable rigid material and has any suitable cross section shape.

The liner 2205 in the interior of 2203 is made of flexible, impervious material, and divides fresh water 2213 and sea water 2214, which enters the space 2203*a* at the bottom of the rigid tube through the equalization pipe 2206. The equalization pipe conveys sea water to the bottom of the liner. The liner is self-balanced because sea water will push the liner upward, if the fresh water volume is reduced, or vice versa. The liner can replace the ordinarily rigid, costly bottom of a tank.

The cover 2207 serves to cover the rigid tube, and can be made of any suitable impervious material. The opening 2208 on the upper wall of the rigid tube. The pumping plant 2209 is carried at the exterior wall of the rigid tube next to the opening 2208. The pumping plant includes sump 2210, pumps 2211, and power supply and control system (not shown). Fresh water from the rigid tank will pass through the opening 2208, then enter the sump 2210 of the pumping plant. The pumps 2211 suck water from the sump, pump it into the discharge pipeline 2212 in which it flows to a water distribution or treatment facilities (not shown) on land.

When fresh water enters the shore tank, as from pipe 1610, the fresh water will displace the sea water, and the sea water on the other side of the liner will be dispelled back into the sea through the equalization pipeline. When fresh water is pumped out of the sump, additional fresh water in the shore tank will be pushed into the sump by the sea water, which enters into the other side of the liner of the shore tank via the equalization pipeline. When fresh water no longer enters the shore tank from the floating tube, fresh water in the shore tank can continuously supply to the pumps, so that the water demands can be continuously met.

Drained bags can be transported back to the fresh water sources for reuse. The aforementioned procedures and means to transport fresh waters from their sources to their destinations can be repeatedly used.

The above method consists of the following major representative components:

obtaining fresh water from a water source, filling, towing, and draining bags, transporting delivered fresh water into water distribution or treatment facilities, and return and reuse of the bags.

Many derivatives of these components can be readily obtained.

Figure 2:
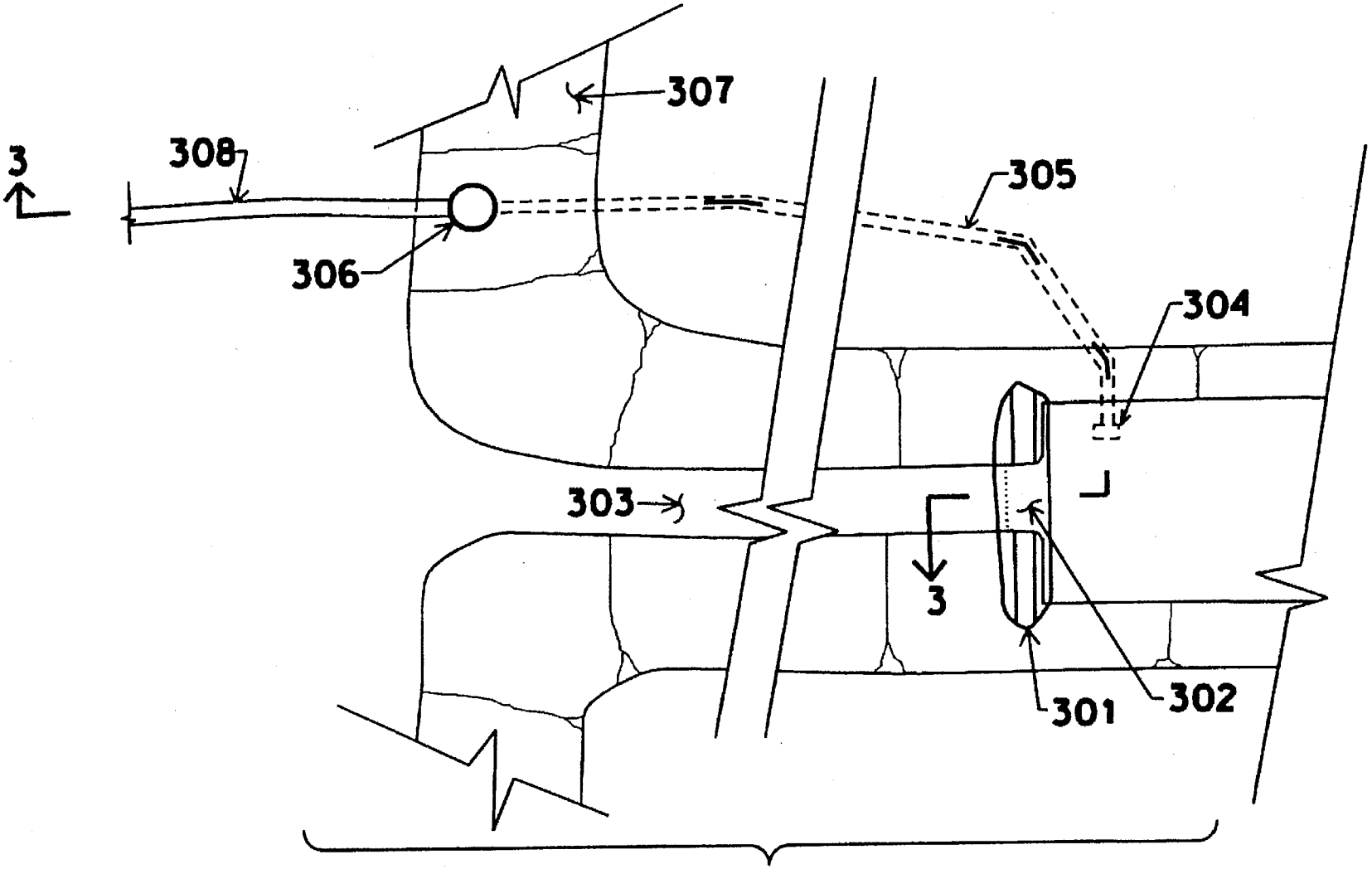
FIG. 2 is a schematic plan view of a fresh water reservoir created by a dike on a river, an optional tank also being shown.
Figure 3:
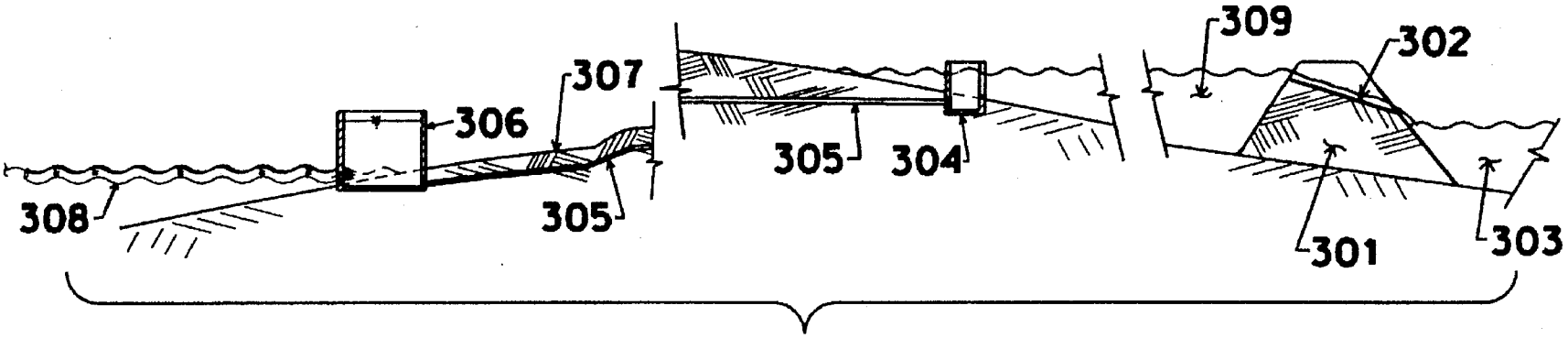
FIG. 3 is a sectional view taken on lines 3—3 in FIG. 2.

Referring to FIGS. 2 and 3, in lieu of a pumping boat anchored in a river to obtain fresh water from a water source, a dike 301 with a spillway 302 may be built in a reach of a river 303, to create a pool of water 309 in the river upstream of the dike. A water intake structure 304 diverts and guides the water in the pool to flow into a pipeline 305, then into an optional tank 306 built near the shore 307, or into a floating tube 308. Fresh water into the tank will flow into the floating tube, then flow forwards.

Figure 4:
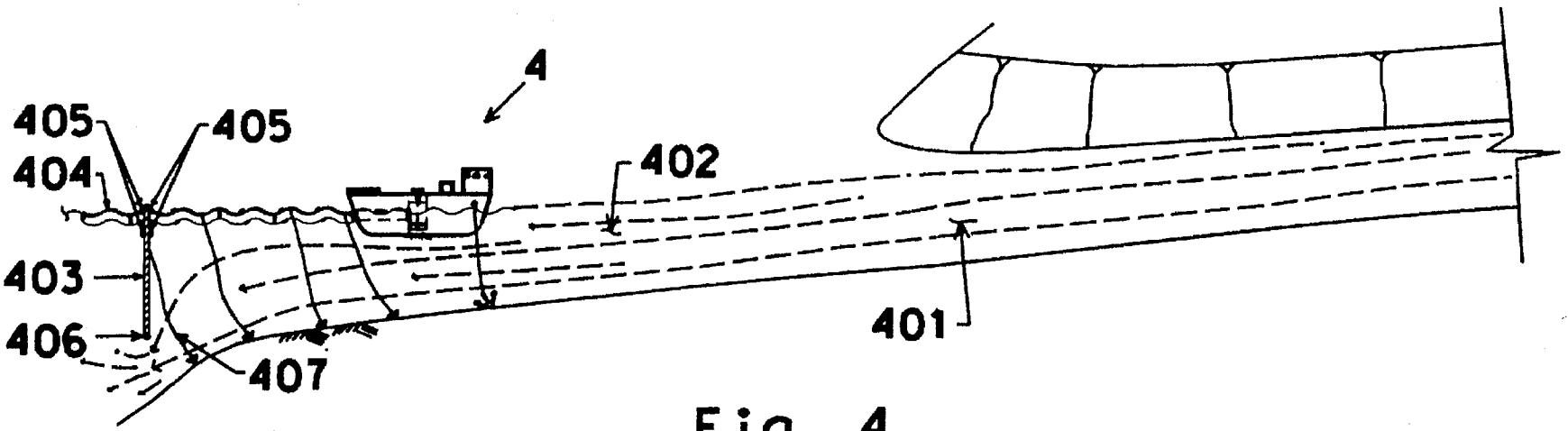
FIG. 4 is a sectional elevation showing use of an alternative pumping boat taking fresh water from a fresh water pool created by a floating flexible belt.

Referring to FIG. 4, in lieu of anchoring a pumping boat in a river to obtain fresh water from a water source, a pumping boat 4 may be anchored outside of a river mouth 401 in a fresh water pool 402, which is created by a continuous, flexible, floating belt 403. The pumping boat will suck the fresh water and pump it into a floating tube 404 to send the fresh water forward.

The floating belt 403 is a piece of continuous membrane made of any suitable material having floats 405 mounted near its top rim, and weight 406 mounted on its bottom rim. The floating belt may have anchors 407 at certain critical locations. Each float 405 is made of lightweight material, which can help the belt to float. The weight is provided by any suitable heavy material which can hold down the bottom rim of the floating belt, so that the floating belt can be roughly in a vertical position. The anchors will help keep the floating belt in a fixed location. The floating belt originates from a shore, or its extension, such as a bay bar, then crosses the extension of the river mouth at certain distance downstream from the river mouth, and reaches an opposite shore or its extension again. Its mid-length can be made to flex or move to accommodate to tides. The floating belt encompasses a space in which fresh water is maintained, and also separates fresh water from sea water, and may be balanced, i.e., positioned by both the fresh water and the sea water. The floating belt will float with the sea waves, so that it will not be significantly subjected to stress created by waves. Any additional fresh water which enters the space encompassed by the floating belt from the river will pass through the bottom gap between the weight of the floating belt and sea floor. Therefore, the floating belt need not be under large forces. The fresh water passing under the floating belt will wash away any intruding sea water, so that the pool of water at the upstream side of the belt can be kept fresh.

Figure 6:
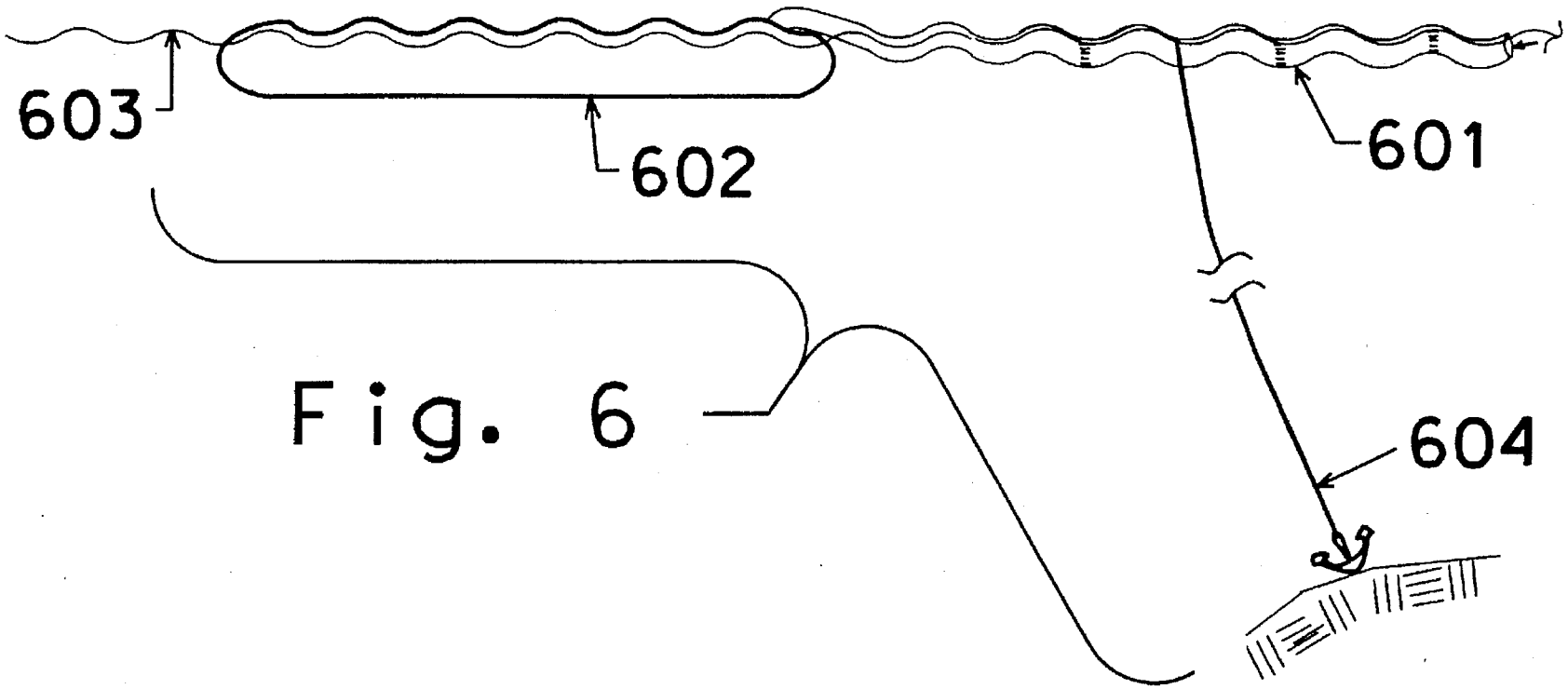
FIG. 6 is an elevation showing a transport bag being filled while floating in the ocean.

Referring to FIG. 6, in lieu of filling a bag with water while contained by a filling float, the filling of the bag can be done by connecting a floating tube 601 directly to a bag 602, which is shown floating on the ocean surface 603. The bag or the floating tube may optionally have an anchoring system 604.

Figure 7:
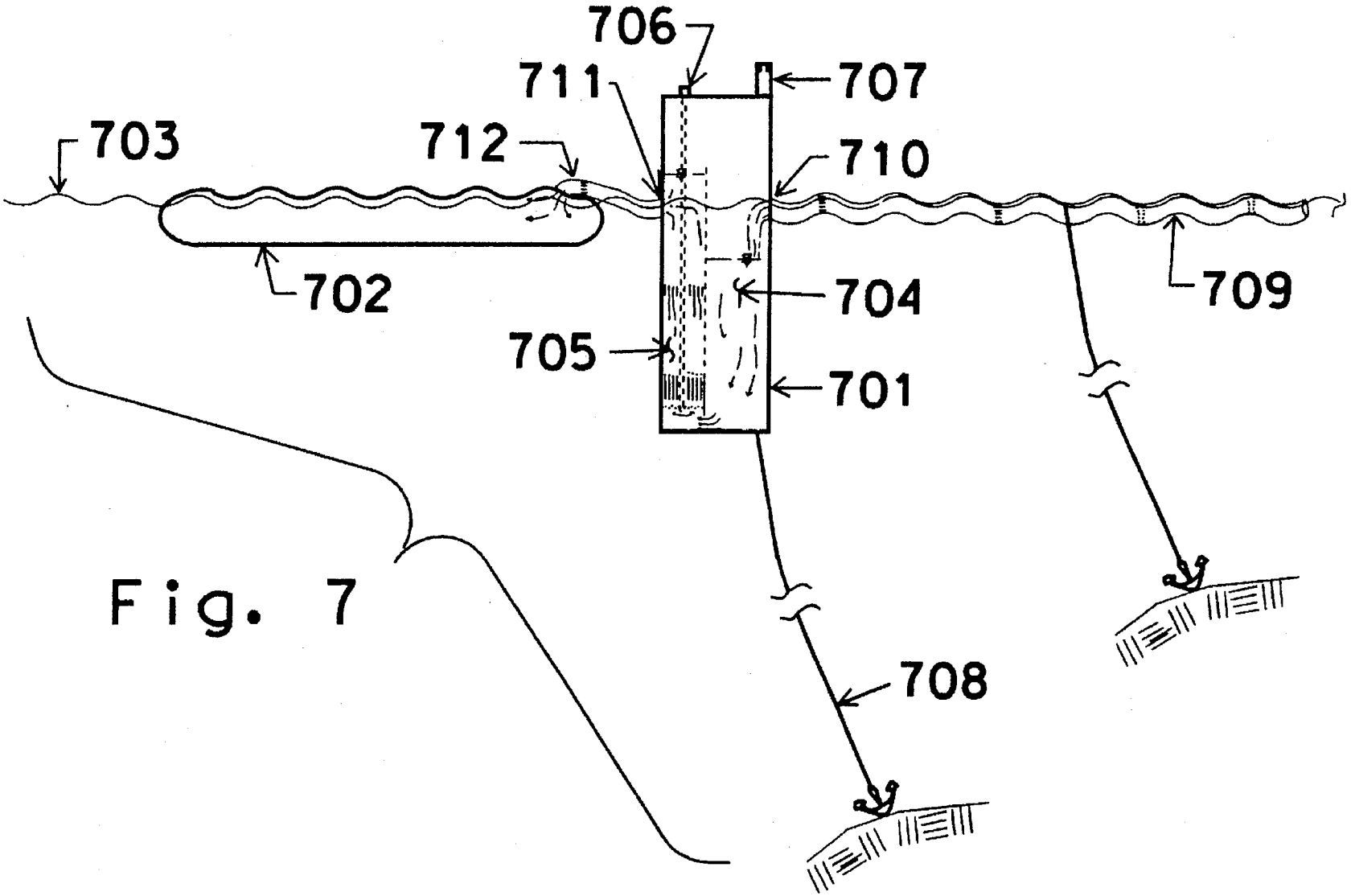
FIG. 7 is an elevational view showing a transport bag is being filled while floating in the ocean, and a pumping tower receiving water from a filling tube and pumping water into the bag via another floating tube.

Referring to FIG. 7, a pumping tower 701, may be employed to help to fill a bag 702, which is floating on the surface of ocean 703. The pumping tower basically is a floating pumping station which has a sump 704, a pumped water tank 705, pumps 706, a control room 707, an anchoring means 708, and pump power supply means (not shown). The sump has an opening 710 to which a floating tube 709 is connected. The sump provides a space in which fresh water discharged from the floating tube 709 can be temporarily stored.

The pump sucks water from the sump, then pumps it into the pumped water tank. The pumped water tank provides a space in which water pumped from the sump can be temporarily stored or passed through. The water surface in the pumped water tank is raised by pumping if the water is temporarily stored in the pumped water tank. This raised water surface level will provide a gentle and smooth driving force, which can guide the fresh water through discharge opening 711 from the pumped water tank into another floating tube 712, then into a bag 702. The anchoring means 708 comprises anchors and chains, as shown, or propellers, or equivalents (not shown), which can keep the pumping tower afloat at a fixed location.

A control room 707 on 701 allows operators to control the pumping tower. The pump power supply could be by electricity generation or convey (power line transmission) systems, if the pumps have motors. The pump power supply means can be engines, turbines, and fuel tanks, if the pumps have no motors.

Figure 12:
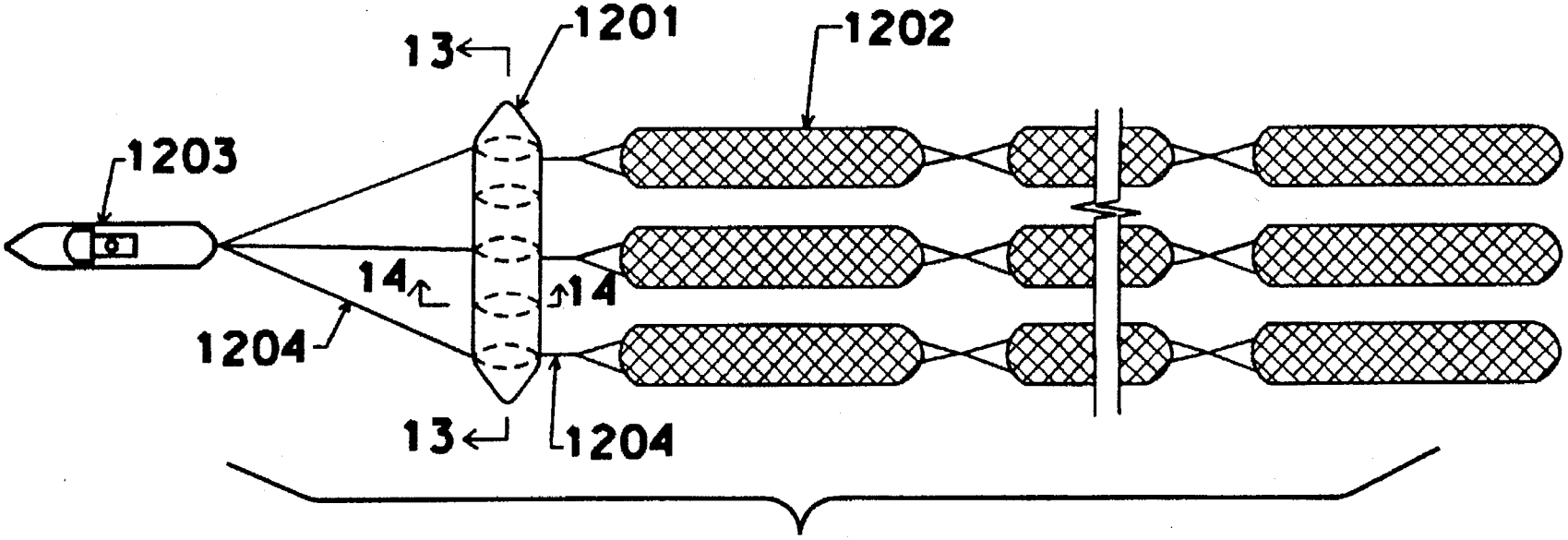
FIG. 12 is a plan view showing an alternative method of towing the bags.

Referring to FIG. 12, a transverse towing spacer 1201 can be used to keep desired spaces between adjacent bags 1202, when the bags are towed longitudinally by a tug boat 1203 with tow lines 1204. The tow lines are cables, ropes or chains. The tow lines connect the trains of bags to the towing spacer, and also connect the towing spacer to the tug boat.

Figure 13:
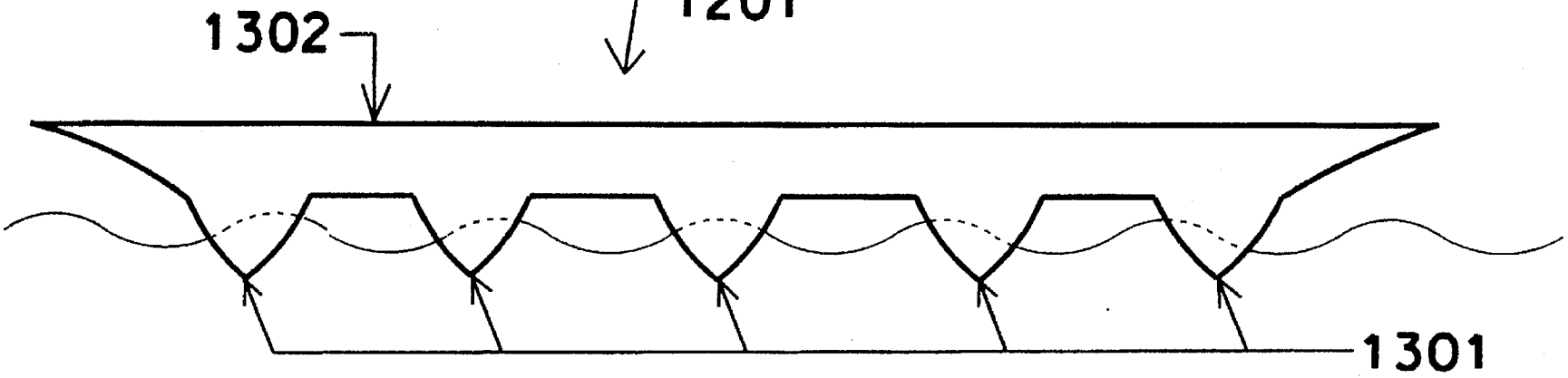
FIG. 13 is a sectional view taken on lines 13—13 in FIG. 12.
Figure 14:
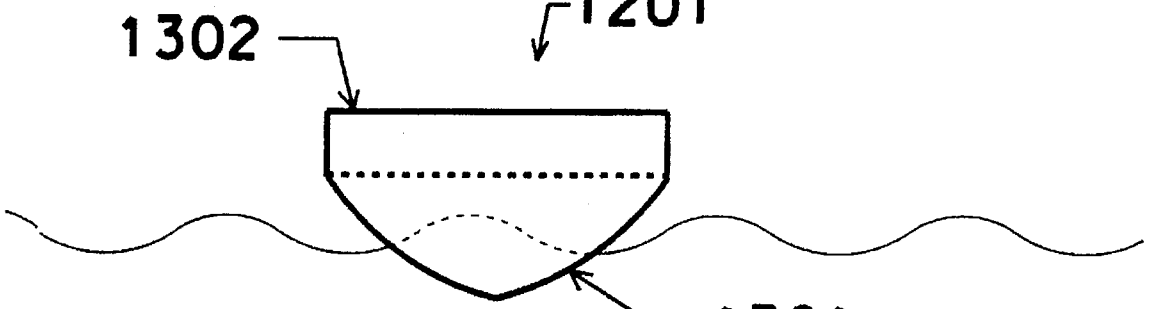
FIG. 14 is a view like FIG. 13 showing a modification.

Referring to FIGS. 12, 13, and 14, the towing spacer is a float, which consists of many downwardly tapering cones 1301 and a top deck 1302. The deck is a structure which provides the strength to keep the trains of bags separate when being towed. The cones are cone-shaped floats which will keep the deck float above sea water surface, so that the deck will not be submerged to generate large drag forces when being towed broadsided.

Figure 25:
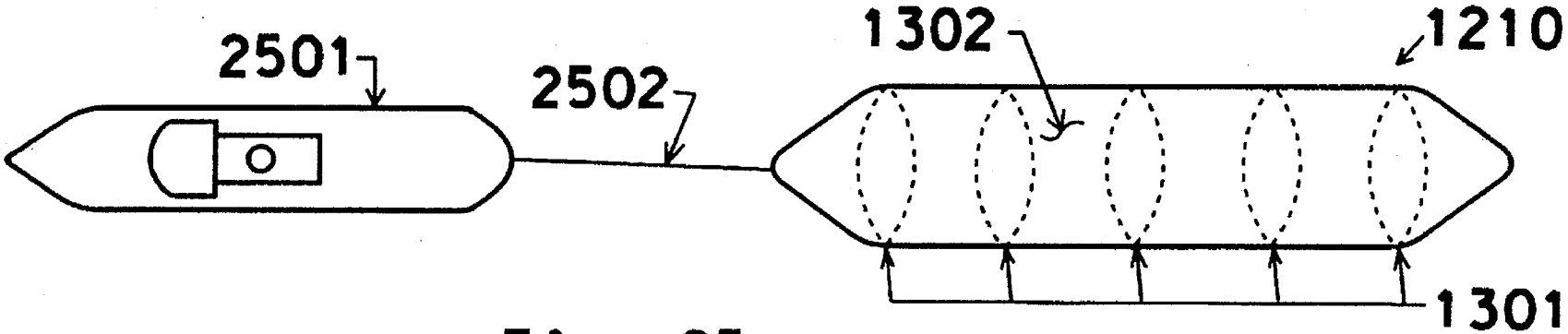
FIG. 25 is a schematic plan view showing a towing spacer being towed by a tug boat.

Referring to FIG. 25, the drained bags can be put on the deck 1302 of the now longitudinally elongated towing spacer 1201, so that the bags can be towed by a tug boat 2501 with a cable 2502 back to the fresh water source for refill. The streamline shape of the cones 1301 of the towing spacer help to reduce drag forces on the towing spacer when being towed narrow-sided, as in FIG. 25.

Figure 19:
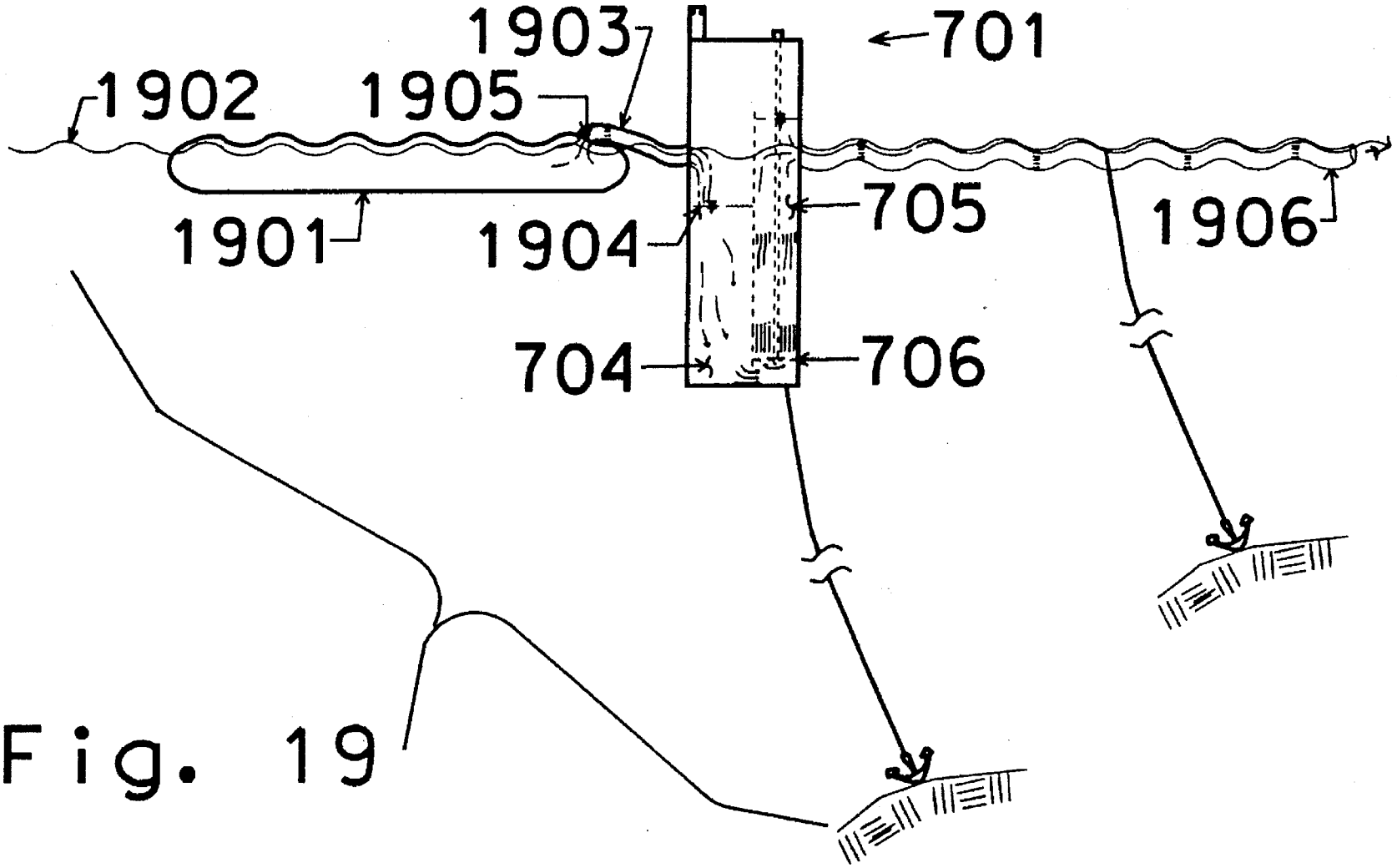
FIG. 19 is an elevational view showing a transport bag being drained via a pumping tower.

Referring to FIG. 19, in lieu of using the draining float to drain a bag, pumping tower 701 can be used to help drain a fresh water filled bag 1901, while it is floating on the ocean surface 1902. This method is similar to, but reverse from, that shown in FIG. 7 for filling a bag. Due to its lighter density than that of sea water, fresh water has the tendency to float up, and will be pushed out of the bag by the sea water through the bag's opening 1905 into the floating tube 1903.

The fresh water in the floating tube will then enter the sump 704 in 701. The low water surface 1904 in the sump, created by pumping water from the sump into the pumped water tank 705, will help the water in the floating tube to drain into the sump, and thus will help to drain the bag. The fresh water in the pumped water tank will flow into another floating tube 1906, then flow onwards.

Figure 20:
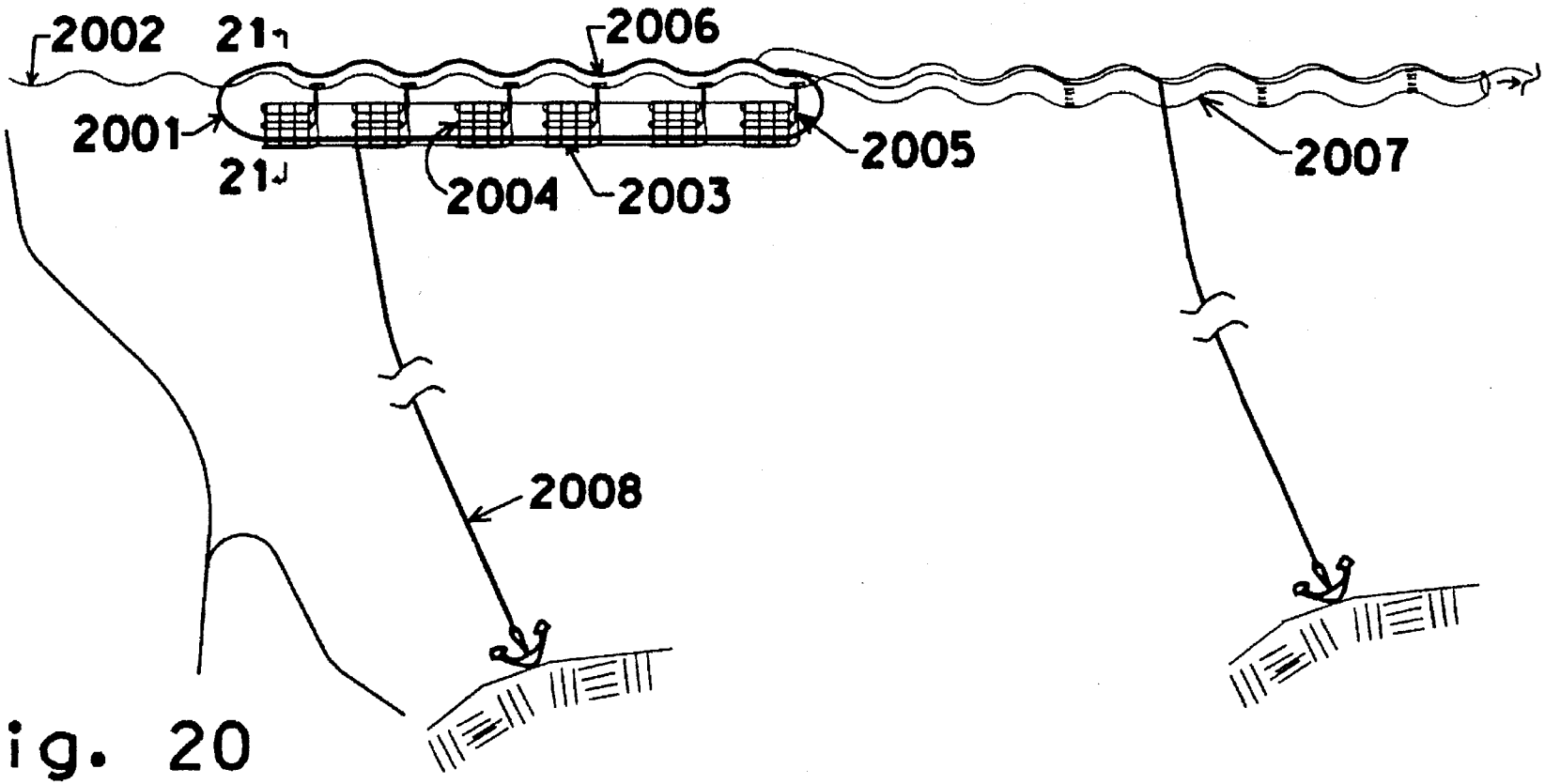
FIG. 20 is an elevational view showing a bag being drained while positioned by floating nets.
Figure 21:
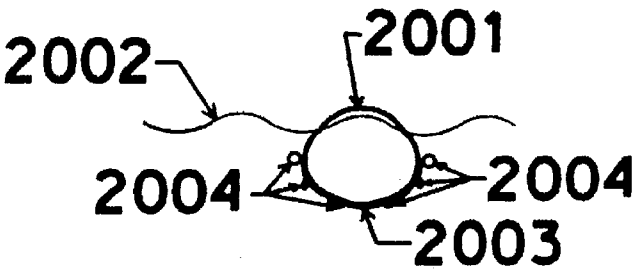
FIG. 21 is a section taken on lines 21—21 of FIG. 20.

Referring to FIGS. 20 and 21, the draining of a bag 2001, which is floating on the ocean surface 2002, can be helped by the floating net 2003. The floating net is one on which many air bags 2004 are mounted, and such bags can be inflated or deflated with gas. One end of an air hose 2005 is connected to each of the air bags. The other end of the air hose is mounted on a float 2006, which is made of lightweight material. That end of the air hose has an associated valve. Many of such air hose ends may be mounted on one float. Gas can be forced through the valves, so that the bags can be inflated or deflated as desired.

An anchoring means 2008 may be mounted on the floating net to help anchor a fresh water transport bag. The anchoring means may consist of anchors and cables. In use, a floating net is placed beneath a bag. Then, some of the air bags can be inflated or deflected by forcing gases through the valves of their air hoses, so that the air bags will provide adequate buoyancy forces to the floating net; and, therefore, the floating net will provide additional buoyancy forces to the bag, so that fresh water in the bag can be pushed out into the floating tube 2007.

Figure 28:
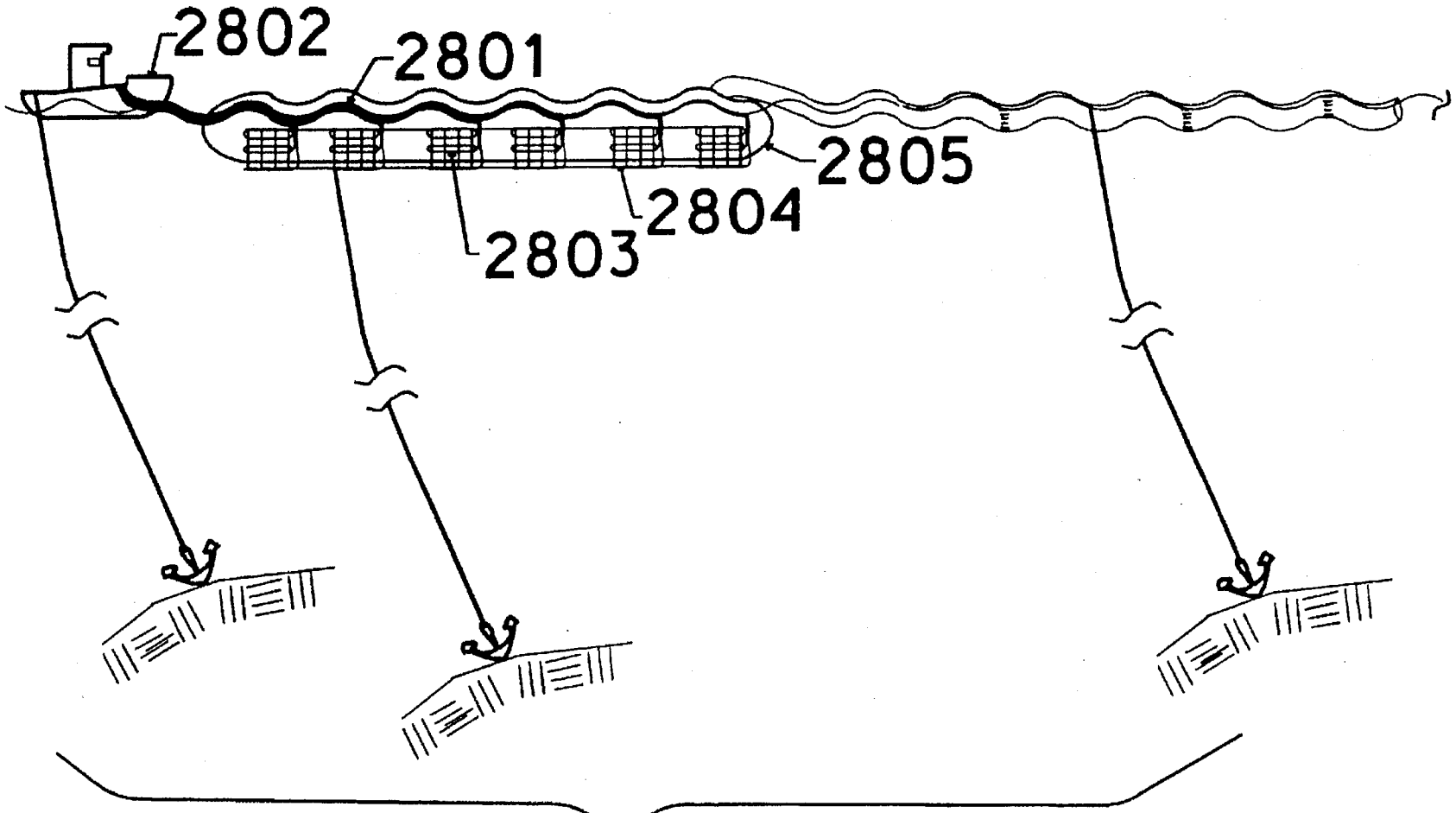
FIG. 28 is an elevation showing use of pneumatic means to assist water input or output from a water transport bag.

Referring to FIG. 28, in lieu of mounting on a float 2006, as described in FIGS. 20 and 21, the end of the air hose 2801, which has a valve, can be mounted on a control boat 2802, which is a boat with equipment that can provide and remove gases to/from the air bags 2803 of the floating nets 2804, that controls the buoyancy of the bag 2805. The functions and methods of using the floating nets are the same as described for those for FIGS. 20 and 21.

Figure 23:
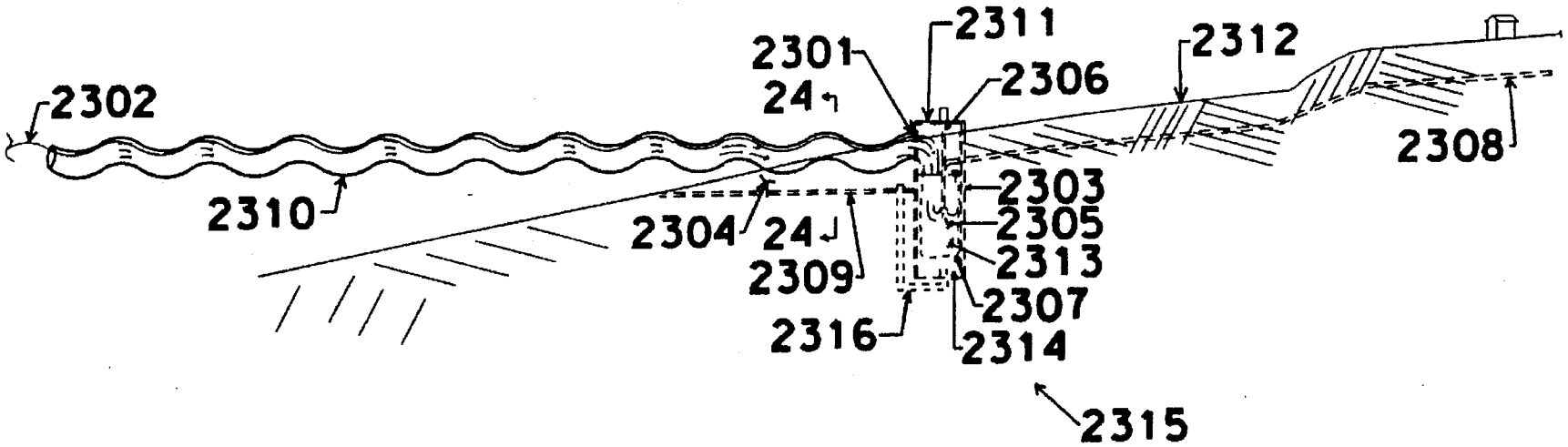
FIG. 23 is a sectional elevational view of a shore pumping station and its associated floating tube and pipeline.
Figure 24:
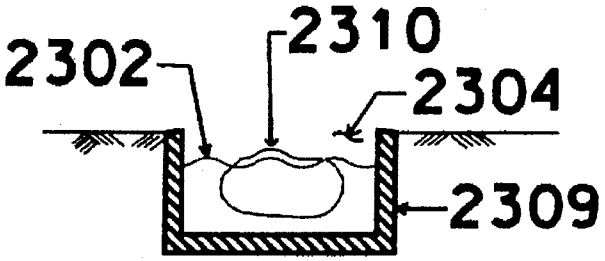
FIG. 24 is a section taken on lines 24—24 in FIG. 23.

Referring to FIGS. 23 and 24, in lieu of connecting with a shore tank as described in FIG. 22, the downstream end 2301 of a floating tube 2310 may connect with a shore pumping plant 2315, which consists of a large, rigid tube 2303, a liner 2307 in the tube, an equalization pipe 2316, a cover 2311, pumps 2306, a tube channel 2304, and power supply and control means (not shown). The shore pumping plant my be constructed near the shore 2312. The rigid tube is made of any suitable material and has any suitable cross section shape. The liner 2307, made of flexible, impervious material, divides fresh water 2313, which is stored in the sump 2305 and sea water 2314, which enters the space on the bottom of the rigid tube through equalization pipe 2316. The equalization pipe is a pipe which conveys sea water to the bottom of the liner.

The liner is self-balanced because sea water will push the liner upward if the fresh water volume is reduced, or vice versus. This liner can replace the ordinarily rigid, costly bottom of a sump. The cover is a cover for the rigid tube. The cover can be made of any suitable impervious material. Fresh water flowing into the sump from the floating tube will be pumped by the pumps into the discharge pipeline 2308, then to a water distribution or treatment facilities (not shown) on land. When fresh water enters the sump, the fresh water will displace the sea water on the other side of the liner to be driven back into the sea through the equalization pipeline. When fresh water is pumped out of the sump, additional fresh water will flow into the sump from the floating tube.

The tube channel 2304 provides adequate depth of sea water all the way to the exterior wall of the rigid tube of the shore pumping plant, so that a floating tube can float on the sea water surface in the channel until the end of the floating tube can be connected to the rigid tube 2303. The tube channel has a channel liner 2309, which is made of any suitable material and which has any suitable cross section.

Figure 26:
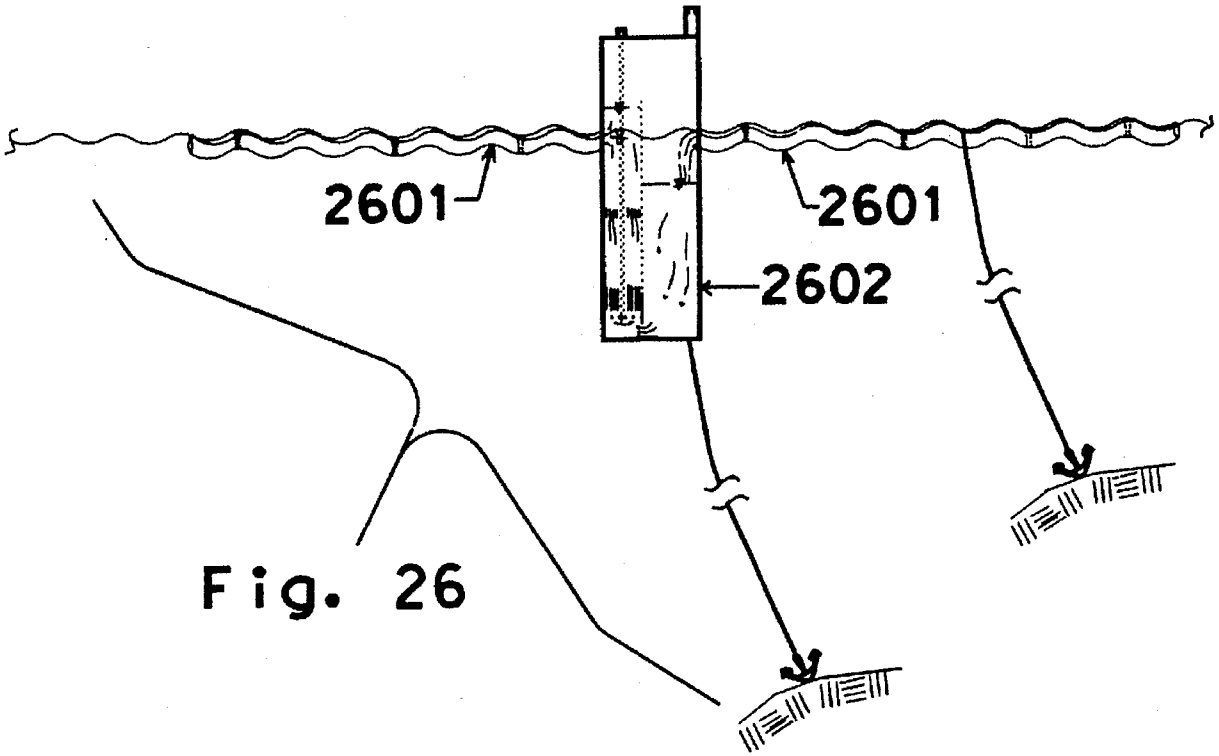
FIG. 26 is a sectional side view of an alternative which uses a pumping tower and floating tubes to transport fresh water.

Referring to FIG. 26, in lieu of transporting fresh water by bags, fresh water can be conveyed in floating tubes 2601. Fresh water will be pumped by the pumping towers 2602, which will be spaced apart along the line of the floating tubes. The operations of the pumping towers will be similar to those described for FIGS. 7 or 19 except that there are no bags to be filled or drained.

The foregoing is considered as illustrative only of the principles of the present invention. Furthermore, since numerous modifications and changes will readily occur to those skilled in the art, it is not desirable to limit the present invention to the exact construction and operation shown and described. Accordingly, all suitable modifications and equivalents may be restored to falling within the scope of the present invention as claimed.

We claim:

1. In primary equipment to transfer fresh water relative to a transport bag to float in the sea, for guided movement, the combination comprising:

a) first apparatus to be located in the sea at a first location and containing a first sump for storage of fresh water, b) second apparatus associated with said first apparatus and movable up and down in the sea relative to the first apparatus, c) said second apparatus defining a first containment receptacle to receive the bag for transfer of fresh water between said sump and the bag, d) said receptacle configured to allow movement of the fresh water filled bag independently of the receptacle in response to submergence of said receptacle, thereby to facilitate floating of the fresh water filled bag in the sea for said guided movement.

2. The combination of claim 1 including an elongated tube extending from and communicating with said first apparatus to transfer fresh water to or from the sump, said tube containing said fresh water adapted to float in the sea.

3. The combination of claim 2 including float means and anchor means connected with said tube, which is flexible.

4. The combination of claim 1 wherein said first apparatus includes structure configured to float in the sea while anchored, there being pump means associated with said structure to pump fresh water from the sump for discharge a) into the bag in said receptacle, or b) into a tube floating on the ocean.

5. The combination of claim 4 wherein said second apparatus extends alongside said first apparatus.

6. The combination of claim 5 wherein said second apparatus extends at levels relative to said first apparatus to be submergible while the first apparatus remains extending upwardly above sea level.

7. The combination of claim 6 including ballasting carried by said second apparatus to be removable for allowing the second apparatus to rise in the sea, and attachable for causing the second apparatus to descend in the sea, said second apparatus having associated float means biasing the second apparatus to rise in the sea as referred to.

8. The combination of claim 1 including towing net means encompassing at least part of the fresh water filled bag during separation thereof from said second means.

9. The combination of claim 1 including secondary equipment to effect removal of fresh water from the water-filled bag.

10. The combination of claim 9 wherein said secondary equipment includes:

e) third apparatus to be located in the sea at a second location and containing a second sump for storage of fresh water removed from the bag floatably transported to said second location, f) fourth apparatus associated with said third apparatus and movable up and down in the sea relative to said third apparatus, g) said fourth apparatus defining a second containment receptacle to receive the bag for transfer of fresh water between the second sump and the bag, h) said second receptacle configured to allow capture of the floating fresh water filled bag in a submerged condition of the fourth apparatus.

11. The combination of claim 10 including an elongated delivery tube extending from and communicating with said third apparatus to deliver fresh water from the second sump to a fresh water collection point at or near the sea shore.

12. The combination of claim 10 including float means and anchor means connected with said delivery tube, which is flexible.

13. The combination of claim 10 wherein said third apparatus includes structure configured to float in the sea while anchored, there being duct means carried by said structure to conduct fresh water flow from the bag for discharge into the second sump.

14. The combination of claim 13 wherein said fourth apparatus extends alongside said third apparatus.

15. The combination of claim 14 wherein said fourth apparatus extends at levels relative to said third apparatus to be submergible while the third apparatus remains extending upwardly above sea level.

16. The combination of claim 15 including ballasting carried by said fourth apparatus to be removable for allowing the fourth apparatus to rise in the sea, and attachable for causing the fourth apparatus to descend in the sea, said fourth apparatus having associated float means biasing to cause the fourth apparatus to rise in the sea, as referred to.

17. The combination of claim 1 including a pumping boat and floating tube means to transfer fresh water from a fresh water body to the transport bag, via the boat and the floating tube.

18. The combination of claim 17 wherein the bag has at least one short filling duct attached thereto, whereby the bag may be punctured at a location in registration with said filling tube, for fresh water filling into the bag.

19. The combination of claim 1 wherein the containment receptacle has an inclinable wall for use in controllably draining water from the bag to said sump.

20. The combination of claim 1 including a shore-located water storage facility connectible with said sump via a floating tube.

21. The combination of claim 1 wherein the sump includes an associated flexible liner positioned to contact fresh water above the liner and sea water below the liner, and movable up and down in conjunction with fresh water transfer into and out of the sump.

22. The combination of claim 17 including a water retention belt anchored in a river flow zone emptying to the sea, to retain a fresh water body separated from the pumping boat having a fresh water intake from said fresh water body.

23. The combination of claim 8 including a plurality of said bags encompassed by said net means for towing in a train.

24. The combination of claim 23 including a towing spacer which extends laterally, and to which multiple of said bags are connected in parallel longitudinal trains by said net means for simultaneous towing.

25. The combination of claim 1 including floating tube means connected to said bag for direct transfer of fresh water into or from the bag.

26. The combination of claim 10 wherein said third apparatus includes structure configured to float in the sea, while anchored, there being pump means operable to suck fresh water from one of the following:

i) the bag in said receptacle, ii) a water transfer tube floating on the ocean, and to discharge fresh water to one of the following:

iii) the second sump, iv) a water transfer tube floating on the ocean.

* * * * *